US007168214B2

(12) United States Patent
Wall

(10) Patent No.: US 7,168,214 B2
(45) Date of Patent: Jan. 30, 2007

(54) TWO-PIECE JOINING DEVICE FOR SHEET PILE RETAINING WALLS

(76) Inventor: Georg Wall, Hans-Graessel-Weg 20, D-81375 Muenchen (DE)

( * ) Notice: Subject to any disclaimer, the term of this patent is extended or adjusted under 35 U.S.C. 154(b) by 471 days.

(21) Appl. No.: 10/643,543

(22) Filed: Aug. 19, 2003

(65) Prior Publication Data

US 2005/0076595 A1 Apr. 14, 2005

(30) Foreign Application Priority Data

Aug. 27, 2002 (DE) ..... 102 39 331

(51) Int. Cl.
*E04C 4/00* (2006.01)

(52) U.S. Cl. ..... 52/309.11; 52/426; 52/562; 405/278; 403/122

(58) Field of Classification Search ..... 52/309.11, 52/426, 562; 405/278; 403/122, 76, 339, 403/340

See application file for complete search history.

(56) References Cited

U.S. PATENT DOCUMENTS

| | | | | |
|---|---|---|---|---|
| 965,157 | A * | 7/1910 | Conkling | 405/278 |
| 1,032,109 | A * | 7/1912 | Buckingham | 405/279 |
| 1,071,985 | A * | 9/1913 | Troye | 405/249 |
| 1,341,949 | A * | 6/1920 | Troye | 405/278 |
| 2,128,928 | A * | 8/1938 | Murray, Jr. | 405/278 |
| 2,558,367 | A * | 6/1951 | Madsen | 24/586.1 |
| 3,302,412 | A * | 2/1967 | Hunsucker | 405/278 |
| 4,069,631 | A * | 1/1978 | Nahr | 52/309.5 |
| 5,437,520 | A * | 8/1995 | Cherry et al. | 405/279 |
| 6,715,964 | B2 * | 4/2004 | Nottingham | 405/278 |
| 7,055,286 | B2 * | 6/2006 | Tierney | 52/120 |

FOREIGN PATENT DOCUMENTS

| | | |
|---|---|---|
| DE | 27 55 431 A1 | 6/1979 |
| DE | 81 05 981.7 | 10/1981 |
| DE | 39 07 348 A1 | 9/1990 |
| DE | 200 17 445 U1 | 4/2001 |
| FR | 2648493 | 12/1990 |

* cited by examiner

*Primary Examiner*—Naoko Slack
*Assistant Examiner*—Chi Q. Nguyen
(74) *Attorney, Agent, or Firm*—Milde & Hoffberg, LLP

(57) ABSTRACT

The joining device serves for connecting two adjacent individual elements (5, 11) of a sheet pile retaining wall which are to be pile-driven in each case, e.g. for connecting two adjacent pipes of a sheet piling. The first joining element comprises a button strip (9) which is received in a hollow space (15) between two hook strips (14) of a second joining element (2). In order to be able to better absorb tensile forces occurring during driving, the first joining element (2) comprises holding portions, e.g. holding strips (16) which at least partly encompass the hook strips (14) of the second joining element (3) and thus prevent a widening of the hook strips during driving.

5 Claims, 2 Drawing Sheets

TWO-PIECE JOINING DEVICE FOR SHEET PILE RETAINING WALLS

BACKGROUND OF THE INVENTION

The invention relates to a two-piece joining device for sheet pile retaining walls that consists of two interlocking strip-shaped joining elements.

Sheet pile retaining walls such as sheet pilings or foundations are e.g. constructed of pipes that are to be pile-driven into the ground, a joining element being welded to each pipe and interlocking with a corresponding joining element of an adjacent pipe.

Customary joining elements are so-called LARSSEN's hooks; cf. e.g. FR 2648493.

So-called ball-and-socket joining elements are in particular used in the USA. The first joining element (ball joining element) is affixed, as a rule, welded, to a first pipe with a base and comprises a neck strip projecting away from the base and the pipe and an adjoining button strip; the second joining element is welded to the adjacent pipe with its base and comprises two hook strips projecting away from its base and the pipe, which define between them a hollow space and embrace the button strip of the first joining element that is inserted into the hollow space upon the pile-driving of the pipes in such a way that it is held in the hollow space. An example of such joining elements is shown in the German Utility Model 200 17 445; cf. FIGS. 1 and 3 thereof.

Upon the pile-driving of the piles with the welded joining elements, considerable tensile forces partly occur between the pipes, which are i.a. caused by the non-homogeneity of the ground. The tensile forces may partly be that high so that, in particular in the case of conventional Larssen's hooks, but also in the case of ball-and socket connections, the interlocking joining elements are bent up and detached from each other. In the case of ball-and-socket connections which, as compared with LARSSEN's hooks, are capable of absorbing higher tensile forces the hook strips of the second joining element may be bent up by the button strip of the first joining element to such an extent that the button strip of the first joining element jumps out of the hook strips of the second joining element so that the connection between the pipes is interrupted there. This is of particular disadvantage if a liquid-tight connection is to be established between the pipes. If this jumping out of the two joining elements is noticed at all, the pile-driving must be repeated; if the jumping out is not noticed, which is frequently the case, the wall constructed in this fashion is no longer liquid-tight, which entails considerable subsequent work to eliminate this damage.

There is, of course, the possibility of designing the joining elements as a whole in a more stable fashion, e.g. with thicker wall thicknesses; however, since the price of these joining elements is substantially determined by weight of the material, i.e. usually the weight of steel, this, as a rule, is refrained from.

SUMMARY OF THE INVENTION

The invention is based on the object of improving a two-piece joining device according to the type of a ball-and-socket connection in such a way that high tensile forces between the individual elements to be pile-driven can also be absorbed without substantially increasing the weight of material of the joining elements of the joining device.

For this purpose, the base of the first joining element comprises on its two longitudinal sides holding portions, e.g.

continuous holding strips, that project away from the base, at least at a few points, which at least partly encompass the outer sides of the hook strips of the second joining element and, due to this, prevent a widening of the hook strips in the case of tensile forces between the two individual elements to be pile-driven.

In conventional ball-and-socket connections the button strip and the hook strips of the two joining elements substantially only contact each other at two points and/or small areas of contact, seen in cross-section, so that the entire tensile forces must be absorbed via these two areas. Due to the additional holding portions on the first joining element of the joining device according to the invention, which at least partly encompass the hook strips of the second joining element, two further holding portions are still present in the most simple design of a joining device according to the invention so that correspondingly higher tensile forces can also be absorbed.

According to a preferred embodiment the hook strips of the second joining element are also provided with a button strip each on their ends. The holding portions, e.g. holding strips extending along the entire length of the first joining element, are also designed as hook strips and at least partly encompass these button strips. In such a design of a joining device, the joining elements again abut against each other at four points and/or small areas if tensile forces occur between the individual elements to be pile-driven so that, as compared with conventional joining devices, at least twice the tensile forces can be absorbed.

For a full understanding of the present invention, reference should now be made to the following detailed description of the preferred embodiments of the invention as illustrated in the accompanying drawings.

DESCRIPTION OF THE PREFERRED EMBODIMENT

Figure 1:
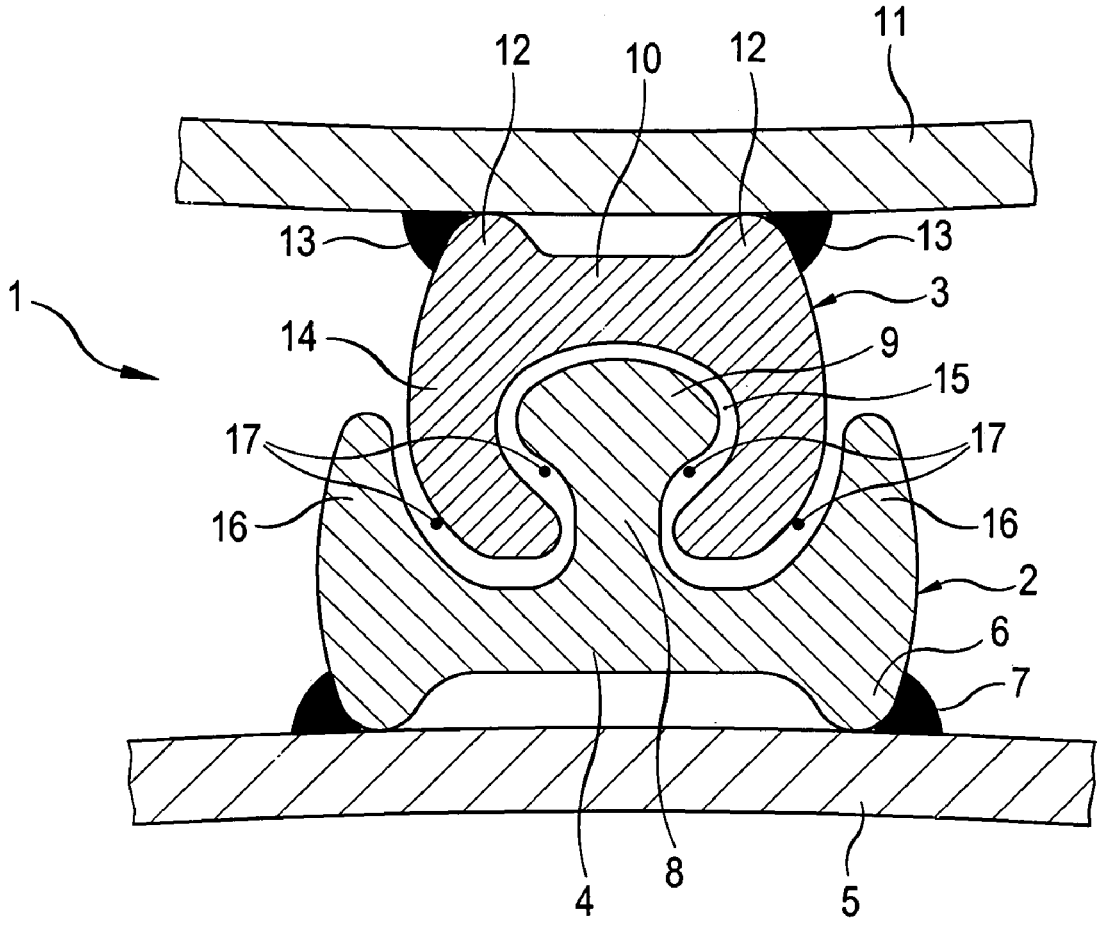
FIG. 1 is a cross-section through a first example of embodiment of a joining device according to the invention.

The preferred embodiment of the present invention will now be described with reference to FIGS. 1 and 2 of the drawings. Identical elements in the two figures are designated with the same reference numerals.

A joining device 1 consisting of two interlocking strip-shaped joining elements 2 and 3 is shown in FIG. 1, which are e.g. designed as extruded one-piece sections. The first joining element 2 comprises a base 4 on whose two longitudinal sides beads 6 directed against a steel pipe 5 are provided, which rest on the pipe 5 and are welded to the pipe 5 by means of weld seams 7.

The joining element 2 comprises a neck strip 8 in the center of the base, which projects away from said base in a substantially vertical way, and an adjoining button strip 9 with an approx. oval cross-section.

The second joining element 3 also comprises a base 10 which comprises beads 12 on its longitudinal edges, which are directed against a further steel pipe 11 and rest on the pipe 11 and are connected to it by means of weld seams 13. On both sides of the base, hook strips 14 project away from the base 10 and the pipe 11, which define a hollow space 15, in which part of the neck strip 8 and the button strip 9 of the first joining element 2 are received at a slight distance to the inner sides of the hook strips 14 and the base 10. The hook strips 14 end approx. in the area of the short neck strip 8, the center lines of the two hook strips intersecting each other approx. in the area of the base 4 of the first joining element at an angle of approx. 90°.

Holding strips 16 pointing away from the base 4 and the pipe 5 are provided on both longitudinal sides of the base 4 of the first joining element, whose inner contour is approx. adapted to the outer contour of the hook strips 14 of the second joining element 3 and encompasses the hook strips 14 approx. up to their center. The ends of the holding strips 16 are rounded and then pass over to a substantially plane or slightly arched outer wall of the joining element 2.

For instance, a sheet piling can be constructed with a number of pipes connected in this fashion. For this purpose, pipe 5 with the first joining element 2 welded to it is first of all pile-driven into the ground. Subsequently, pipe 11 with the second joining element 3 welded to it is placed on the ground in such a way that the button strip 9 slides into the hollow space 15 of the second joining element 3. Thereupon, pipe 11 is pile-driven. This procedure is repeated with further pipes that are connected each via a joining device, until the construction of the sheet piling is complete.

If, during pile-driving of the pipes tensile forces should occur between the two pipes 5 and 11, they are absorbed in four areas 17 between the button strip 9 and the inner sides of the hook strip 14 and between the outer sides of the hook strips 14 and the inner side of the holding strips 15, which are drawn in black.

Figure 2:
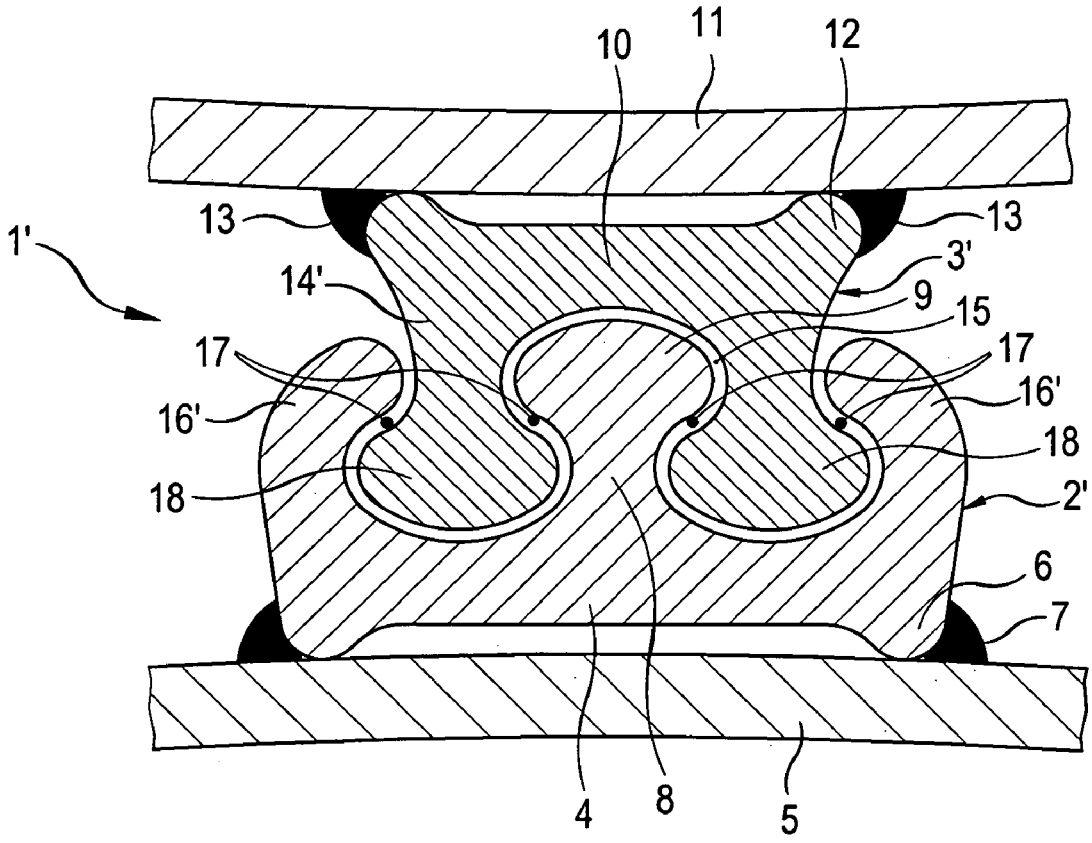
FIG. 2 is a cross-section through a further example of embodiment of a joining device according to the invention.

A modified joining device 1' consisting of two joining elements 2' and 3' is shown in FIG. 2.

For identical parts or parts having the same effect the same reference numerals and/or reference numerals provided with a apostrophe (') are used in this Fig.

The first joining element 2' has again a base 4 with beads 6 on its longitudinal edges, which are connected to a pipe 5 by means of weld seams 7. A neck strip 8 with an adjoining button strip 9 projects away from the center of the base 4.

The second yoining element 3' comprises, as in the example of embodiment according to FIG. 1, a base 10 with beads 12 on its longitudinal sides, which are connected to a further pipe 11 by means of weld seams 13. The hook strips 14' of this second joining element 3' are modified, as compared with the first example of embodiment, to the effect that they are provided on their ends with a button strip 18 with an approx. oval cross-section. The button strip 9 of the first joining element 2' is received in the hollow space 15 formed by the hook strips 14' at a slight distance. The holding strips of the first joining element are designed as hook strips 16' in this case, which encompass the outer sides of the button strips 18, seen in the peripheral direction, up to approx. their center. The outer contour of the holding strips 16' is adapted to the outer contour of the button strips 18 in this case so that, again, there is only a slight distance between these two elements. Again, the imaginary center lines of the ends of the two holding strips 16' intersect each other at an angle of about 90°.

The pile-driving of the two pipes 5 and 11 takes place as in the first example of embodiment, any occurring tensile forces being absorbed between the two pipes 5 and 11 in four areas 17 that are drawn in black.

The joining elements 2, 2' and 3 and 3' are extruded one-piece sections made of steel in the described case. Other materials are, of course, also possible. If a sheet piling is constructed in a sandy ground, the connection elements and also the pipes may e.g. be of a synthetic material.

There has thus been shown and described a novel two-piece joining device for sheet pile retaining walls which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirt and scope of the invention are deemed to be coverd by the invention, which is to be limited only by the claims which follows.

The invention claimed is:

1. In a two-piece joining device-sheet pile retaining walls, which comprises two interlocking, strip-shaped joining elements for connecting two adjacent individual sheet piling elements of the sheet pile retaining walls, having (a) a first joining element being affixable with a first base to an individual first sheet piling element and comprising (1) a neck strip projecting away from the first base and the individual first sheet piling element and (2) an adjoining button strip, and (b) a second joining element being affixable with a second base to an individual second sheet piling element and comprising two hook strips projecting away from the second base and the individual second sheet piling element, which define between them a hollow space and at least partially encompass the button strip of the first joining element so that it is held in the hollow space, the first base base of the first joining element comprises, two longitudinal sides, holding portions projecting away from said two longitudinal sides of the first base, which at least partially embrace outer sides of the hook strips of the second joining element and prevent a widening of the hook strips in the case of tensile forces between the two individual sheet piling elements.

2. A two-piece joining device according to claim 1, wherein the holding portions are holding strips.

3. A two-piece joining device according to claim 1, wherein the first joining element with its base extends between two ends, and wherein the holding portions extend substantially continuously along the base of the first joining element from one end thereof to the other.

4. A two-piece joining device according to claim 1, wherein the hook strips of the second joining element are each provided with a button strip on their ends and wherein the holding portions of the first joining element at least partially encompass these button strips.

5. A two-piece joining device according to claim 1, wherein the joining elements are extruded steel profiles.

* * * * *